US010133224B2

(12) United States Patent
Hoshino

(10) Patent No.: US 10,133,224 B2
(45) Date of Patent: Nov. 20, 2018

(54) IMAGE FORMATION APPARATUS AND ERROR NOTIFICATION METHOD

(71) Applicant: Oki Data Corporation, Tokyo (JP)

(72) Inventor: Masahiko Hoshino, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/436,342

(22) Filed: Feb. 17, 2017

(65) Prior Publication Data

US 2017/0261902 A1 Sep. 14, 2017

(30) Foreign Application Priority Data

Mar. 11, 2016 (JP) ..... 2016-047718

(51) Int. Cl.
*G03G 15/00* (2006.01)

(52) U.S. Cl.
CPC ..... *G03G 15/5016* (2013.01); *G03G 15/553* (2013.01); *G03G 15/502* (2013.01); *G03G 15/55* (2013.01); *G03G 2221/1892* (2013.01)

(58) Field of Classification Search
CPC .. G03G 15/5016; G03G 15/502; G03G 15/55; G03G 15/553; G03G 2221/1892
See application file for complete search history.

(56) References Cited

U.S. PATENT DOCUMENTS

2005/0254832 A1* 11/2005 Kumai ..... G03G 15/556 399/12
2010/0290791 A1* 11/2010 Sonoda ..... G03G 15/55 399/12
2015/0234335 A1* 8/2015 Nakamoto ..... G03G 15/5033 399/26

FOREIGN PATENT DOCUMENTS

JP 2014-008678 A 1/2014

* cited by examiner

*Primary Examiner* — Joseph S Wong
(74) *Attorney, Agent, or Firm* — Metrolexis Law Group, PLLC

(57) ABSTRACT

An image formation apparatus includes: a replaceable part attached to an image formation device and including an information storage unit having unique identification information stored therein; an error detector which detects an occurrence of an anomaly; an error code storage unit having a first error code and a second error code stored therein, each code indicating a content of error display concerning the anomaly; and a controller which determines whether the replaceable part is of a first type or a second type based on the identification information. The controller outputs a first notification signal indicating a content corresponding to the anomaly of the first error code if the replaceable part is of the first type when the error detector detects the anomaly, and outputs a second notification signal indicating a content corresponding to the anomaly of the second error code if the part is of the second type.

14 Claims, 6 Drawing Sheets

FIG.5

| | WITH GENUINE TONNER CARTRIDGE (FIRST ERROR CODE) | | WITH NON-GENUINE TONNER CATRIDGE (SECOND ERROR CODE) | |
|---|---|---|---|---|
| | IN JAPANESE | IN ENGLISH | IN JAPANESE | IN ENGLISH |
| COMPARATIVE EXAMPLE 1 | ***:ｴﾗｰ | ***:Error | ***:ｴﾗｰ | ***:Error |
| EXAMPLE 11 | ***:ｴﾗｰ | ***:Error | ***:ｴﾗｰ0 | ***:Error0 |
| EXAMPLE 12 | ｴﾗｰ:*** | Error:*** | ｴﾗｰ0:*** | Error0:*** |
| COMPARATIVE EXAMPLE 2 | ﾍﾙﾌﾟ¥ｴﾗｰｺｰﾄﾞ:*** | Help¥Error Code:*** | ﾍﾙﾌﾟ¥ｴﾗｰｺｰﾄﾞ:*** | Help¥Error Code:*** |
| EXAMPLE 21 | ﾍﾙﾌﾟ¥ｴﾗｰｺｰﾄﾞ:*** | Help¥Error Code:*** | ﾍﾙﾌﾟ¥ｴﾗｰｺｰﾄﾞ:***0 | Help¥Error Code:***0 |
| EXAMPLE 22 | ﾍﾙﾌﾟ¥ｴﾗｰｺｰﾄﾞ:***,*** | Help¥Error Code:***,*** | ﾍﾙﾌﾟ¥ｴﾗｰｺｰﾄﾞ:***,***0 | Help¥Error Code:***,***0 |
| EXAMPLE 23 | ﾍﾙﾌﾟ¥ｴﾗｰｺｰﾄﾞ:***,***,*** | Help¥Error Code:***,***,*** | ﾍﾙﾌﾟ¥ｴﾗｰｺｰﾄﾞ:***,***,***0 | Help¥Error Code:***,***,***0 |
| EXAMPLE 24 | ﾍﾙﾌﾟ¥ｴﾗｰｺｰﾄﾞ:***,***,***,*** | Help¥Error Code:***,***,***,*** | ﾍﾙﾌﾟ¥ｴﾗｰｺｰﾄﾞ:***,***,***,***0 | Help¥Error Code:***,***,***,***0 |
| EXAMPLE 25 | ﾍﾙﾌﾟ¥ｴﾗｰｺｰﾄﾞ:*** | Help¥Error Code:*** | ﾍﾙﾌﾟ¥ｴﾗｰｺｰﾄﾞ0:*** | Help¥Error Code0:*** |
| EXAMPLE 26 | ﾍﾙﾌﾟ¥ｴﾗｰｺｰﾄﾞ:***,*** | Help¥Error Code:***,*** | ﾍﾙﾌﾟ¥ｴﾗｰｺｰﾄﾞ0:***,*** | Help¥Error Code0:***,*** |
| EXAMPLE 27 | ﾍﾙﾌﾟ¥ｴﾗｰｺｰﾄﾞ:***,***,*** | Help¥Error Code:***,***,*** | ﾍﾙﾌﾟ¥ｴﾗｰｺｰﾄﾞ0:***,***,*** | Help¥Error Code0:***,***,*** |
| EXAMPLE 28 | ﾍﾙﾌﾟ¥ｴﾗｰｺｰﾄﾞ:***,***,***,*** | Help¥Error Code:***,***,***,*** | ﾍﾙﾌﾟ¥ｴﾗｰｺｰﾄﾞ0:***,***,***,*** | Help¥Error Code0:***,***,***,*** |
| COMPARATIVE EXAMLE 3 | ﾍﾙﾌﾟ | Help | ﾍﾙﾌﾟ | Help |
| EXAMPLE 31 | ﾍﾙﾌﾟ | Help | ﾍﾙﾌﾟ0 | Help0 |
| EXAMPLE 32 | ﾍﾙﾌﾟ | Help | 0ﾍﾙﾌﾟ | 0Help |

ERROR CODES NOT APPLICABLE
(WARNING SIGNAL)

IMAGE FORMATION APPARATUS AND ERROR NOTIFICATION METHOD

CROSS REFERENCE TO RELATED APPLICATIONS

This application claims priority based on 35 USC § 119 from prior Japanese Patent Application No. 2016-047718 filed on Mar. 11, 2016, entitled "IMAGE FORMATION APPARATUS AND ERROR NOTIFICATION METHOD", the entire contents of which are incorporated herein by reference.

BACKGROUND OF THE INVENTION

1. Field of the Invention

This disclosure is related to an image formation apparatus to form an image on a record medium, and an error notification method applicable to the image formation apparatus.

2. Description of Related Art

When a conventional image formation apparatus detects the occurrence of an anomaly (an error), the image formation apparatus displays a message indicating a content of the occurring anomaly (error information) on a display unit (see Japanese Patent Application Publication No. 2014-8678, for example).

SUMMARY OF THE INVENTION

However, in the related art, the message indicating the content of the anomaly does not reflect a situation of the image formation apparatus (whether a replaceable part is a genuine part or not, for example). Accordingly, a maintenance staff who receives the message may fail to accurately identify a cause of the anomaly and therefore may be unable to appropriately determine a countermeasure (a maintenance or repair method).

In view of the above, it is an object of one aspect of the invention to provide an image formation apparatus and an error notification method which enable an appropriate determination of a countermeasure for an occurring anomaly by using the notified error information.

A first aspect of the invention is an image formation apparatus that includes: an image formation device which forms an image on a record medium; a replaceable part attached to the image formation device, the replaceable part including an information storage unit having unique identification information stored therein; an error detector which detects an occurrence of an anomaly; an error code storage unit having a first error code and a second error code stored therein, the first error code and the second error code each indicating a content of error display concerning the anomaly, the content of error display concerning the anomaly indicated by the second error code being different from the content of error display concerning the anomaly indicated by the first error code; and a controller which determines whether the replaceable part is of a first type or a second type based on the identification information stored in the information storage unit, outputs a first notification signal indicating a content corresponding to the anomaly of the first error code if the replaceable part is of the first type when the error detector detects the anomaly, and outputs a second notification signal indicating a content corresponding to the anomaly of the second error code if the replaceable part is of the second type when the error detector detects the anomaly.

A second aspect of the invention is an error notification method performed by an image formation apparatus provided with an image formation device which forms an image on a record medium, a replaceable part attached to the image formation device, the replaceable part including an information storage unit having unique identification information stored therein, an error detector which detects an occurrence of an anomaly, and an error code storage unit having a first error code and a second error code stored therein, the first error code and the second error code each indicating a content of error display concerning the anomaly, the content of error display concerning the anomaly indicated by the second error code being different from the content of error display concerning the anomaly indicated by the first error code. The error notification method includes: determining whether the replaceable part is of a first type or a second type based on the identification information stored in the information storage unit; and outputting a first notification signal indicating a content corresponding to the anomaly of the first error code if the replaceable part is of the first type when the error detector detects the anomaly, and outputting a second notification signal indicating a content corresponding to the anomaly of the second error code if the replaceable part is of the second type when the error detector detects the anomaly.

According to the aspects of the invention, a countermeasure for an occurring anomaly is appropriately determined.

BRIEF DESCRIPTION OF THE DRAWINGS

FIG. 5 is a diagram in a table format, which illustrates examples of error codes stored in a memory of the image formation apparatus according to the embodiments.

DETAILED DESCRIPTION OF EMBODIMENTS

Figure 1:
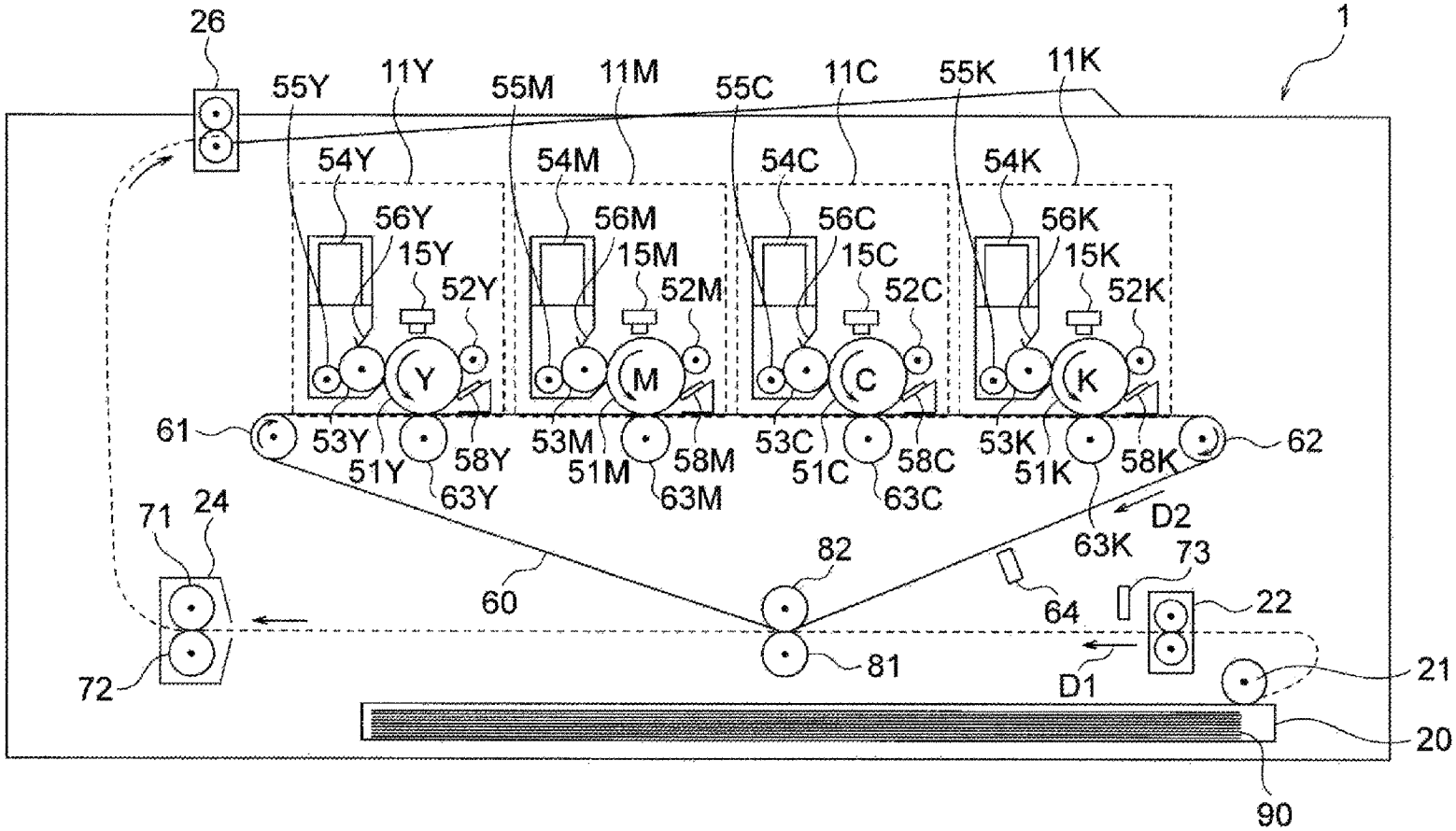
FIG. 1 is a schematic side view illustrating a configuration of an image formation apparatus according to embodiments of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

1. Configuration of Embodiments

FIG. 1 is a schematic side view illustrating a configuration of image formation apparatus 1 according to the embodiments of the invention. As illustrated in FIG. 1, image formation apparatus 1 is an electrophotographic color printer, which is capable of forming (printing) images on a record medium by using yellow (Y), magenta (M), cyan (C), and black (K) developers (toners). Image formation apparatus 1 includes: paper cassette 20 serving as a record medium loader; hopping roller 21 serving as a record medium pickup device; conveyance roller device 22 serving as a record medium conveyor; paper position detection sensor 73 serving as a record medium detector; and four image formation devices 11 (11Y, 11M, 11C, and 11K) which form yellow (Y), magenta (M), cyan (C), and black (K) images, respectively. Moreover, image formation apparatus includes: intermediate transfer belt 60 serving as an intermediate transfer device; drive rollers 61 and 62 each serving as a belt driver; primary transfer rollers 63 (63Y, 63M, 63C, and 63K) each serving as a primary transfer device; secondary transfer roller 81 serving as a secondary transfer device; fixation device 24 serving as a fixer; and paired discharge rollers 26 each serving as a record medium discharger. Although the embodiments describe the case in which image formation apparatus 1 is a color printer, the invention is also applicable to image formation apparatuses of other types including a black-and-white printer, a copier, a facsimile, and the like.

Paper cassette 20 contains multiple record media (paper) 90 in such a way as to stack record media 90 inside. As hopping roller 21 rotates, record media 90 contained in paper cassette 20 are picked up one by one, separately. Conveyance roller device 22 pulls out record media 90 picked up by hopping roller 21, and conveys record media 90 in a D1 direction. Paper position detection sensor 73 detects a front end of each record medium 90 conveyed by conveyance roller device 22.

Image formation devices 11 (11Y, 11M, 11C, and 11K) serving as printing sections include: photoconductor drums 51 (51Y, 51M, 51C, and 51K) which carry electrostatic latent images; light emitting diode (LED) arrays 15 (15Y, 15M, 15C, and 15K) which are light emitting element arrays (light emitting element print heads) serving as exposure devices to perform exposure on photoconductor drums 51; and charge rollers 52 (52Y, 52M, 52C, and 52K) which uniformly charge surfaces of photoconductor drums 51. Moreover, image formation devices 11 (11Y, 11M, 11C, and 11K) include: development rollers 53 (53Y, 53M, 53C, and 53K) serving as developer carriers which supply toners serving as developers to the electrostatic latent images formed on the surfaces of photoconductor drums 51 as a result of the exposure by LED arrays 15, thereby developing the electrostatic latent images; toner cartridges 54 (54Y, 54M, 54C, and 54K) serving as developer feeders to store the toners; supply rollers 55 (55Y, 55M, 55C, and 55K) serving as developer suppliers to supply the toners stored in toner cartridges 54 to development rollers 53; development blades 56 (56Y, 56M, 56C, and 56K) serving as developer control members which control the thicknesses of toner layers on development rollers 53; and cleaning blades 58 (58Y, 58M, 58C, and 58K) which scrape off the toners remaining on photoconductor drums 51. Image formation devices 11 (11Y, 11M, 11C, and 11K) form yellow (Y), magenta (M), cyan (C), and black (K) toner images on photoconductor drums 51 (51Y, 51M, 51C, and 51K), respectively. Here, image formation devices 11Y, 11M, 11C, and 11K have the same structure except for the difference in color of the toners used for development.

Drive rollers 61 and 62 allow endless intermediate transfer belt 60 to be stretched therebetween, and rotate to move intermediate transfer belt 60 in a D2 direction. Primary transfer rollers 63 (63Y, 63M, 63C, and 63K) are disposed opposite to photoconductor drums 51 (51Y, 51M, 51C, and 51K) while interposing intermediate transfer belt 60, and are configured to transfer the toner images (developer images) formed on photoconductor drums 51 (51Y, 51M, 51C, and 51K) onto intermediate transfer belt 60.

Intermediate transfer belt 60 is disposed opposite to image formation devices 11Y, 11M, 11C, and 11K, and is configured to convey a color image that is composed of the toner images of the four colors transferred onto intermediate transfer belt 60. Density sensor 64 serving as a density detector detects an image density on intermediate transfer belt 60. Density sensor 64 includes an infrared LED to emit infrared rays and two light receiving elements (photodiodes), for example. One of the two photodiodes is located at a position to receive specular reflection light of the toner images while the other one of the two photodiodes is located at a position to receive diffuse reflection light. Secondary transfer roller 81 transfers the toner images that have been transferred onto intermediate transfer belt 60 further onto record medium 90.

Fixation device 24 includes heat roller 71 and pressure roller 72. The toner images transferred to record medium 90 are heated and pressed by heat roller 71 and pressure roller 72, and are thus fixed to record medium 90. Paired discharge rollers 26 convey record medium 90 subjected to the fixation of the toner images by fixation device 24, and discharge record medium 90 to the outside of the apparatus.

Figure 2:
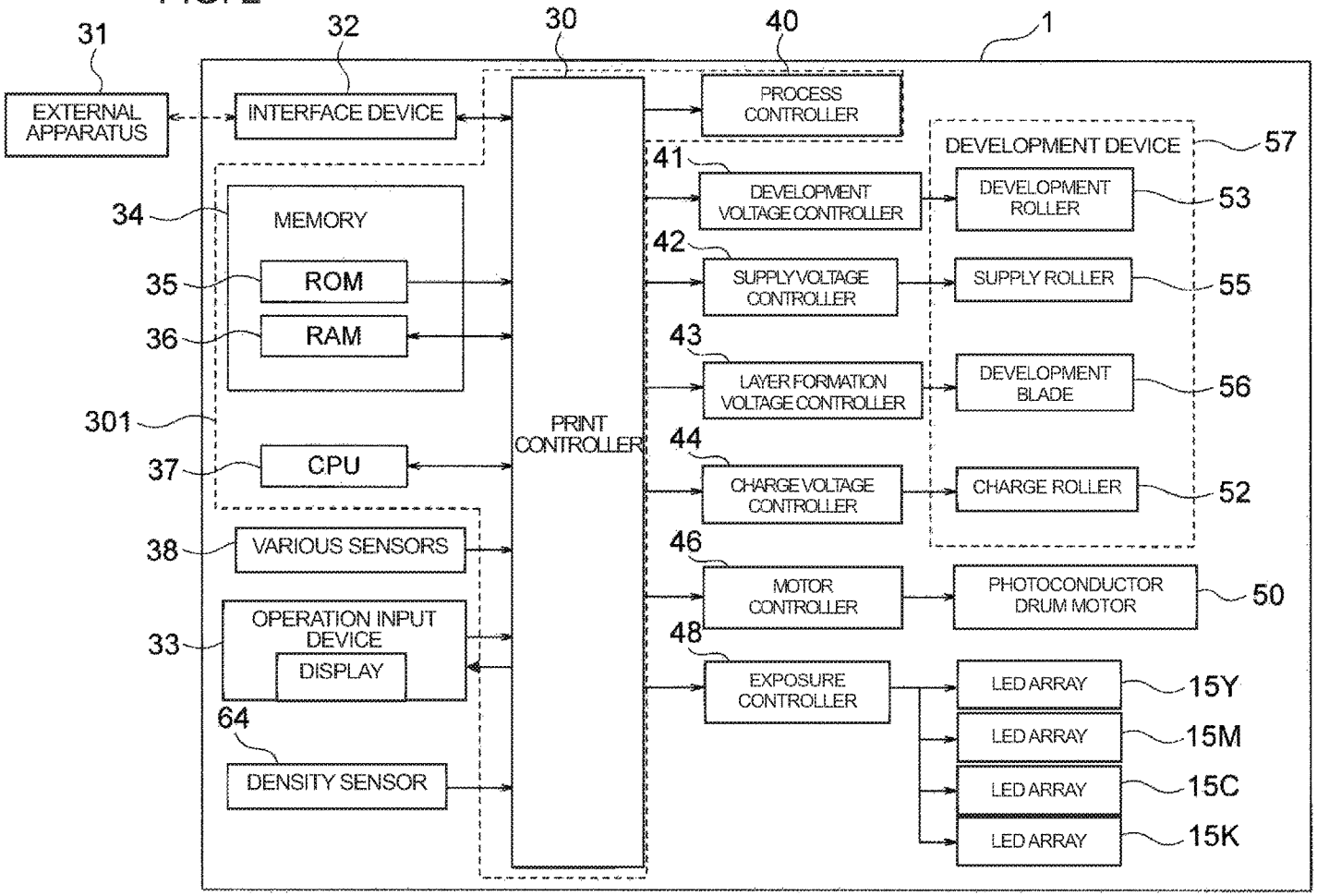
FIG. 2 is a block diagram schematically illustrating a configuration of a control system of the image formation apparatus according to the embodiments.

FIG. 2 is a block diagram schematically illustrating a configuration of a control system of image formation apparatus 1 according to the embodiments. As illustrated in FIG. 2, image formation apparatus 1 includes print controller 30, interface device 32, operation input device 33, memory 34 serving as a storage unit provided with read only memory (ROM) 35 and random access memory (RAM) 36, central processing unit (CPU) 37 serving as a main controller, and various sensors 38. Moreover, image formation apparatus 1 includes: process controller 40; development voltage controller 41 which controls voltages to be applied to development rollers 53; supply voltage controller 42 which controls voltages to be applied to supply rollers 55; layer formation voltage controller 43 which controls voltages to be applied to development blades 56; charge voltage controller 44 which controls voltages to be applied to charge rollers 52; exposure controller 48 which controls LED arrays (15Y, 15M, 15C, and 15K); and motor controller 46 which controls photoconductor drum motors 50. Interface device 32 receives print data and control instructions (control commands) from external apparatus 31 serving as an information input device. External apparatus 31 is an apparatus, such as a personal computer, a tablet terminal, or a mobile telephone, which is located on a network. Image formation apparatus 1 may further include a communication device which transmits either a first notification signal or a second notification signal to be described later to another apparatus on the network.

Print controller 30 controls a print operation by image formation apparatus 1 based on the print data and the control instructions received through interface device 32. For example, operation input device 33 is an operation panel (such as a touch panel) provided with an input device such as an operation button to accept an input operation by an operator, and a display. It is to be noted, however, that the input device and the display of operation input device 33 may be provided separately from each other.

ROM 35 stores control programs (software), control data, and the like, which are used for performing a processing as well as an operation control of the entirety of image formation apparatus 1. RAM 36 temporarily stores a variety of information generated along with execution of the control programs. Note that ROM 35 may be a rewritable flash ROM and the like in the embodiments.

CPU 37 performs a variety of processing as well as the operation control of the entirety of image formation apparatus 1 based on the control programs stored in ROM 35 of memory 34. In the meantime, memory 34 may be an error code storage unit which stores error codes. In addition, memory 34 stores signals based on each error code. The signals stored in memory 34 based on each error code each indicate a content concerning an anomaly. The details will be described later. Various sensors 38 include paper position detection sensor 73 illustrated in FIG. 1, which detects record medium 90 (the position of the record medium).

Density sensor 64 is a sensor which detects the image density on intermediate transfer belt 60. Density sensor 64 is one example of an error detector. At least one of various sensors 38 may be another example of an error detector. Process controller 40 controls the voltages to be applied to the respective rollers based on instructions from print controller 30. Development voltage controller 41 controls the voltages (development voltages) to be applied to development rollers 53 in development device 57, and supply voltage controller 42 controls the voltages (supply voltages) to be applied to supply rollers 55 in development device 57. Layer formation voltage controller 43 controls the voltages to be applied to development blades 56 in development device 57, and charge voltage controller 44 controls the voltages (charge voltages) to be applied to charge rollers 52 in development device 57.

Exposure controller 48 controls exposure operations of LED arrays 15 (15Y, 15M, 15C, and 15K) depending on the print data. The print data are received from external apparatus 31 through interface device 32, for example.

Motor controller 46 controls photoconductor drum motors 50 each serving as a drive force generator, and rotationally drives photoconductor drums 51 as illustrated in FIG. 1. A gear serving as a drive force transmission mechanism to transmit a drive force is provided on one of the ends (an end of a roller shaft extending in a direction perpendicular to the sheet surface on which FIG. 1 is drawn) of each of photoconductor drums 51, development rollers 53, and supply rollers 55. As the gears on each development roller 53 and corresponding supply roller 55 mesh with the gear on corresponding photoconductor drum 51, development roller 53 and supply roller 55 receive a rotary drive force from photoconductor drum motor 50 serving as the drive force generator. Nonetheless, at least one of development rollers 53 and supply rollers 55 may be configured to receive the rotary drive force from a different drive force generator.

Here, interface device 32, operation input device 33, memory 34, CPU 37, various sensors 38, and density sensor 64 are connected to print controller 30 and configured to output signals to print controller 30. Meanwhile, process controller 40, development voltage controller 41, supply voltage controller 42, layer formation voltage controller 43, charge voltage controller 44, motor controller 46, and exposure controller 48 are connected to print controller 30 and they are operated by receiving instruction signals outputted from print controller 30.

Figure 3:
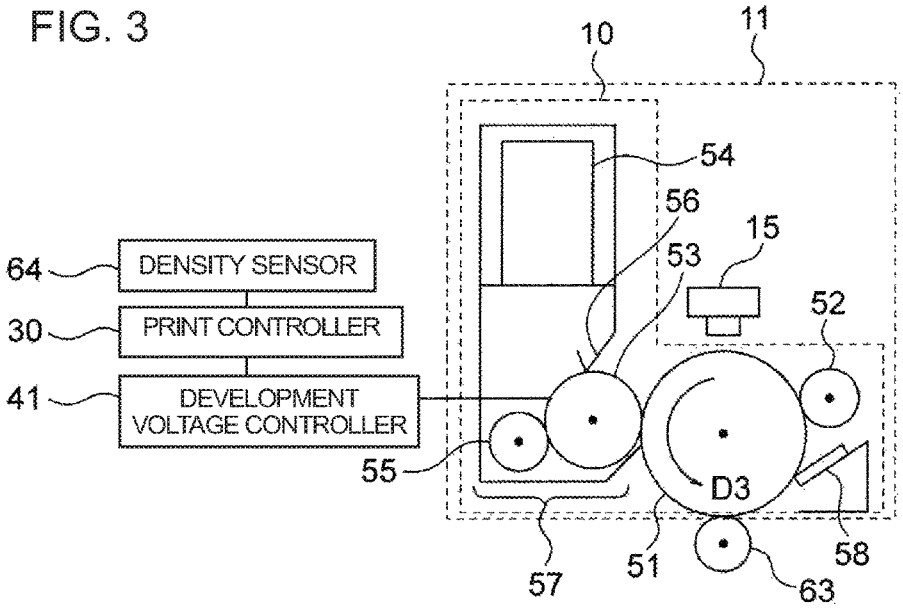
FIG. 3 is a diagram schematically illustrating a configuration of an image formation device in the image formation apparatus according to the embodiments.

FIG. 3 is a diagram schematically illustrating a configuration of each of image formation devices 11 (11Y, 11M, 11C, and 11K) in image formation apparatus 1 according to the embodiments. In FIG. 3, image formation device 11 is connected to development voltage controller 41, while print controller outputs an instruction signal to development voltage controller 41 based on a detection value of density sensor 64. Image formation device 11 includes photoconductor drum 51 serving as an electrostatic latent image carrier which carries an electrostatic latent image, LED array 15, charge roller 52, development roller 53, toner cartridge 54 being a replaceable part that a user can replace with another part, supply roller 55, development blade 56, and cleaning blade 58. Alternatively, image formation device 11 may include printing device (imaging device) 10 which is detachable from a body of image formation apparatus 1 (so that the user can replace this device with another device), and LED array 15. In the latter case, imaging device 10 includes photoconductor drum 51, charge roller 52, development roller 53, toner cartridge 54, supply roller 55, development blade 56, and cleaning blade 58.

The electrostatic latent image is formed on a surface of photoconductor drum 51. Photoconductor drum 51 is rotated in a D3 direction by the drive of photoconductor drum motor 50 illustrated in FIG. 2. A predetermined voltage is applied to charge roller 52 by the control of charge voltage controller 44. Charge roller 52 uniformly charges the surface of photoconductor drum 51.

LED array 15 including multiple LEDs is disposed face-to-face to the surface of photoconductor drum 51. LED array 15 causes the selected LEDs to emit light based on the print data, thereby irradiating selected portions of the surface of photoconductor drum 51 with the light, subjecting the surface of photoconductor drum 51 to exposure, and forming the electrostatic latent image thereon. Toner cartridge 54 stores the toner serving as the developer. The toner is used to draw a visible image on the record medium. The toner in the embodiments contains polyester resin, a colorant, a charge control agent, and a mold release agent, and an external additive (hydrophobic silica) is added thereto. In the meantime, the toner in the embodiments is a developer in the pulverized form obtained by pulverization with an average grain size of 8 μm, for example.

Development roller 53 is formed by attaching an elastic body to the outer periphery of a metal shaft, and is configured to develop the electrostatic latent image formed on photoconductor drum 51 by using the toner. For example, development roller 53 is formed by use of the metal shaft and a semiconductive urethane rubber having a rubber hardness of 70° (Asker C) and serving as the elastic body. Supply roller supplies the toner stored in toner cartridge 54 to development roller 53. Development blade 56 controls a predetermined layer thickness of the toner layer on development roller 53.

Cleaning blade 58 removes the toner which is not transferred to record medium 90 and thus remains on photoconductor drum 51. Note that toner cartridge 54 is a replaceable part which can be replaced by being detached from imaging device 10.

Figure 4:
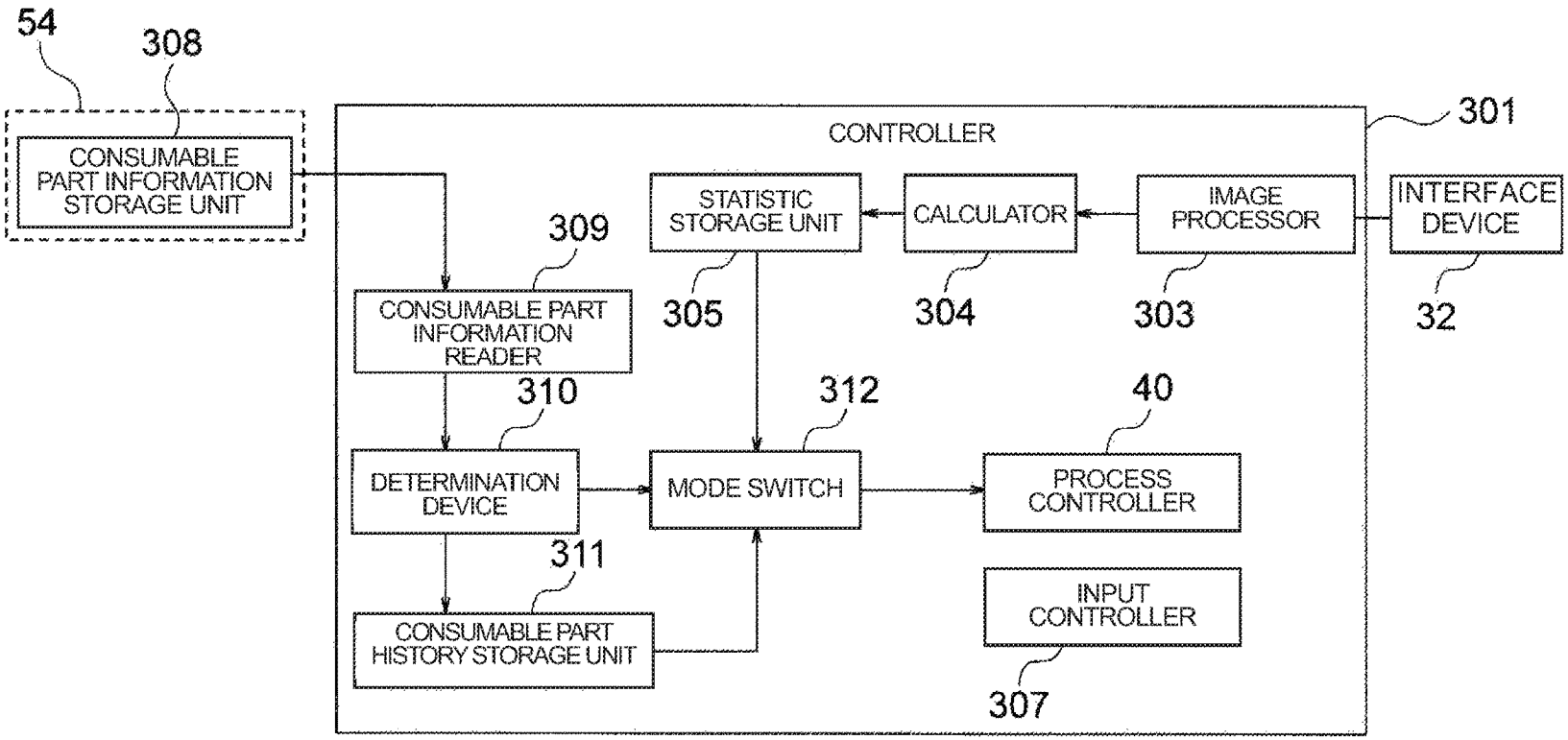
FIG. 4 is a diagram illustrating an example of processing by a controller at the time of replacing a toner cartridge.

FIG. 4 is a diagram illustrating an example of processing by controller 301 at the time of replacing the toner cartridge. Controller 301 includes print controller 30, CPU 37, memory 34, and process controller 40 illustrated in FIG. 2. Interface device 32 receives the print data from external apparatus 31. One example of external apparatus 31 is a host computer. Image processor 303 analyzes the print data received through interface device 32. Based on the print data analyzed by image processor 303, calculator 304 calculates a toner consumption amount. Statistic storage unit 305 stores the sum of the toner consumption amounts calculated by calculator 304. Process controller 40 performs a control operation for forming an image based on the data received from image processor 303. Based on an input of an operator using the operation input device (operation input device 33 in FIG. 2), input controller 307 causes a display of operation input device 33 to display information on a display screen thereof. Consumable part information storage unit 308 serving as an information storage unit is mounted on toner cartridge 54, and is configured to store individual information being identification information on toner cartridge 54.

Consumable part information storage unit 308 includes a non-volatile memory. The non-volatile memory employs at least one of an IC tag and a flash memory, for example.

Consumable part information reader 309 reads the information in consumable part information storage unit 308. For example, consumable part information reader 309 includes an IC tag reader, and reads the information stored in the IC tag of consumable part information storage unit 308 by using the IC tag reader. Using the information read out with consumable part information reader 309, determination device 310 determines whether an attached toner cartridge is a genuine part as a first type or a non-genuine part as a second type. Here, the "genuine part" is apart (including a consumable part) which is supplied (or sold, lent, and so forth) as a part for a target apparatus (a target product) from a party (such as a manufacturer or a distributor) who owns the right to manufacture or sell the target product. The "non-genuine part" is a part other than the genuine parts. Consumable part history storage unit 311 serving as a determination information storage unit stores a consumable part replacement history. The result of a determination made by determination device 310 is also stored in consumable part history storage unit 311.

Mode switch 312 switches an error code to be displayed on the display of operation input device 33 between a display mode (a display mode using a first error code) when genuine toner cartridge 54 is mounted and another display mode (a display mode using a second error code) when non-genuine toner cartridge 54 is mounted. Meanwhile, in this mode switching process, a display content concerning a warning signal which is not an error code is also switched.

FIG. 5 is a diagram in a table format, which illustrates examples of error codes stored in the storage unit (such as memory 34) of image formation apparatus 1 according to the embodiments. It is to be noted, for the sake of explanation, that the table illustrated in FIG. 5 also illustrates error codes that are not stored in the storage unit of image formation apparatus 1 according to the embodiments, and warning signals that are not error codes. Specifically, in FIG. 5, codes of comparative examples 1 to 3 are reference data (data handled by a conventional apparatus) which are not stored in memory 34. In each of comparative examples 1 to 3, an error code (a warning code) in the case where the toner cartridge is the genuine part is the same as an error code (a warning code) in the case where the toner cartridge is the non-genuine part. Meanwhile, in FIG. 5, codes in examples 11, 12, 21 to 28, 31, and 32 represent data of the embodiments which are stored in memory 34. In each of examples 11, 12, and 21 to 28, an error code (the first error code) in the case where the toner cartridge is the genuine part is different from an error code (the second error code) in the case where the toner cartridge is the non-genuine part. In each of examples 31 and 32, a warning signal in the case where the toner cartridge is the genuine part is different from a warning signal in the case where the toner cartridge is the non-genuine part.

The error code in comparative example 1 in FIG. 5 is stored by an image formation apparatus of comparative example 1, which is not provided with mode switch 312 and is therefore unable to switch the error codes. An error code indicating unrestorability which is displayed at the time of attaching genuine toner cartridge 54 to this apparatus, is the same as an error code indicating unrestorability which is displayed at the time of attaching non-genuine toner cartridge 54' to this apparatus. Here, the content of a message in the error information in one case is the same as that in the other case.

The error codes in each of examples 11 and 12 in FIG. 5 are stored by image formation apparatus 1 of the embodiments, in which mode switch 312 can switch the error codes. An error code (the first error code) indicating unrestorability which is displayed at the time of attaching genuine toner cartridge 54 to this apparatus, is different from an error code (the second error code) indicating unrestorability which is displayed at the time of attaching non-genuine toner cartridge 54' to this apparatus. Here, the content of a message in the error information in one case is also different from that in the other case.

The error code in comparative example 2 in FIG. 5 is stored by an image formation apparatus of comparative example 2, which is not provided with mode switch 312 and is therefore unable to switch the error codes. A restorable error code to be displayed at the time of attaching genuine toner cartridge 54 to this apparatus is the same as a restorable error code to be displayed at the time of attaching non-genuine toner cartridge 54' to this apparatus. Here, the content of a message in the error information in one case is the same as that in the other case.

The error codes in each of examples 21 to 28 in FIG. 5 are stored by image formation apparatus 1 of the embodiments, in which mode switch 312 can switch the error codes. A restorable error code (the first error code) to be displayed at the time of attaching genuine toner cartridge 54 to this apparatus is different from a restorable error code (the second error code) to be displayed at the time of attaching non-genuine toner cartridge 54' to this apparatus. Here, the content of a message in the error information in one case is also different from that in the other case.

The warning signal in comparative example 3 in FIG. 5 is stored by an image formation apparatus of comparative example 3, which is not provided with mode switch 312 and is therefore unable to switch the warning signal. A warning signal being caution information not included in the error codes, which is displayed at the time of attaching genuine toner cartridge 54 to this apparatus, is the same as a warning signal being caution information not included in the error codes, which is displayed at the time of attaching non-genuine toner cartridge 54' to this apparatus. Here, the content of a message in one case is the same as that in the other case.

The warning signals in each of examples 31 and 32 in FIG. 5 are stored by image formation apparatus 1 of the embodiments, in which mode switch 312 can switch the warning signals. A warning signal being caution information not included in the error codes, which is displayed at the time of attaching genuine toner cartridge 54 to this apparatus, is different from a warning signal being caution information not included in the error codes, which is displayed at the time of attaching non-genuine toner cartridge 54' to this apparatus. Here, the content of a message in one case is also different from that in the other case.

2. Operation of Embodiments

In the embodiments, controller 301 determines whether toner cartridge 54 as the replaceable part is the genuine part or the non-genuine part, based on the identification information stored in consumable part information storage unit 308. When controller 301 detects that a detection value of density sensor 64, representing an example of the error detector, is abnormal and when toner cartridge 54 is the genuine part, controller 301 outputs a first notification signal (a signal based on the error code representing the case of the genuine part in the table of FIG. 5), which indicates the content corresponding to an anomaly in the first error codes. When controller 301 detects that the detection value of density sensor 64 is abnormal and when toner cartridge 54 is the non-genuine part, controller 301 outputs a second notification signal (a signal based on the error code representing the case of the non-genuine part in the table of FIG. 5), which indicates the content corresponding to an anomaly in the second error codes.

Figure 6:
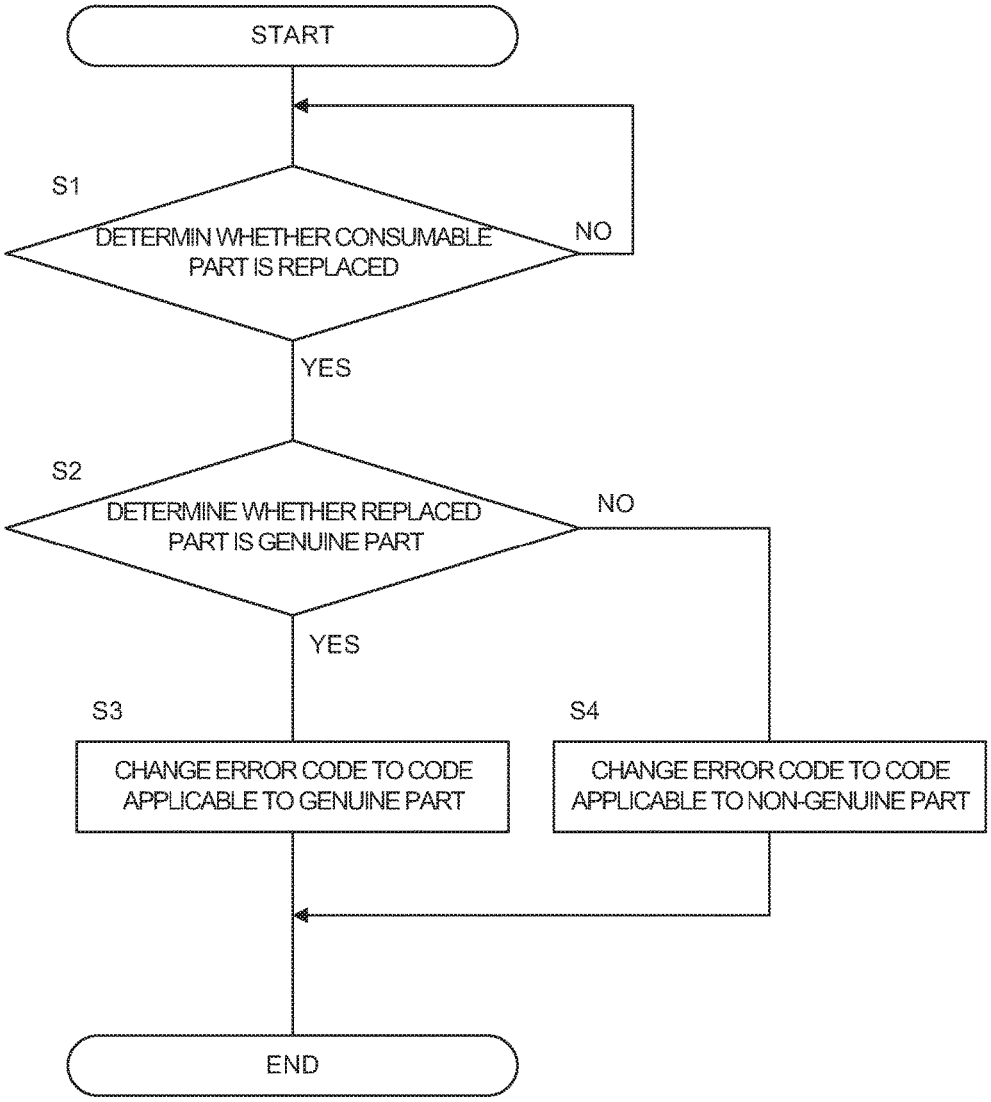
FIG. 6 is a flowchart illustrating the processing at the time of replacing a toner cartridge in the image formation apparatus according to the embodiments, in which the toner cartridge is a replaceable part (such as a consumable part).

FIG. 6 is a flowchart illustrating the processing (an error notification method) at the time of replacing toner cartridge 54 in the image formation apparatus 1 according to the embodiments, in which toner cartridge 54 represents the replaceable part (such as a consumable part) of image formation apparatus 1 according to the embodiments. When the replacement of toner cartridge 54 is detected (YES in step S1), determination device 310 determines whether attached toner cartridge 54 is the genuine part, based on the information stored in consumable part information storage unit 308 which is read by consumable part information reader 309 (step S2). When the attached toner cartridge 54 is determined as the genuine part (YES in step S2), mode switch 312 sets an error code display mode of input controller 307 to a genuine mode (step S3). When the attached toner cartridge 54 is determined as the non-genuine part (NO in step S2), mode switch 312 sets the error code display mode of input controller 307 to a non-genuine mode.

Here, the detection of the replacement of toner cartridge 54 in step S1 is achieved by a contact sensor or a non-contact sensor, for example. Meanwhile, in step S2, replaced toner cartridge 54 is determined to be the genuine part when the information read by consumable part information reader 309 matches predetermined identification information, for example. On the other hand, in step S2, replaced toner cartridge 54 is determined to be the non-genuine part when the information read by consumable part information reader 309 does not match the predetermined identification information, for example. In the meantime, in step S2, replaced toner cartridge 54 is determined to be the non-genuine part also when consumable part information reader 309 cannot read any information, for example.

Meanwhile, the following processing may take over the processing in step S2 and step S3 illustrated in FIG. 6. For example, mode switch 312 may set the error code display mode of input controller 307 to the genuine mode only when determination device 310 determines that the attached toner cartridge 54 is the genuine part and when toner cartridge 54 immediately before the replacement also turns out to be the genuine part based on history information stored in consumable part history storage unit 311. In other cases, mode switch 312 may set the error code display mode of input controller 307 to the non-genuine mode.

3. Effects of Embodiments

As described above, according to image formation apparatus 1 according to the embodiments, the error code when genuine toner cartridge 54 is attached is different from the error code when non-genuine toner cartridge 54' is attached. As a consequence, the maintenance staff (a call center) who takes up the maintenance work can appropriately identify a cause of the error by checking the error code at the point of receiving the notification.

Moreover, at the point of receiving the notification, it is possible to explain to a client who uses the non-genuine part, that the maintenance work is subject to fees, and thus to provide appropriate maintenance service.

Here, consumable part history storage unit 311 may accumulate the result of the determination as to whether each replaceable part (the consumable part) used in the past was the genuine part or the non-genuine part, and output and display a notification signal based on a third error code (which is different from the first and second error codes) applicable to the case in which the genuine replaceable part is currently used but the non-genuine replaceable part had been used in the past.

Although the case where the replaceable part was toner cartridge 54 has been described above, it is also possible to define printing device 10 illustrated in FIG. 3 as the aforementioned replaceable part.

4. Description of Applications

Although the embodiments have described the printer of the intermediate transfer type that uses the toners as the example of the image formation apparatus, the invention is also applicable to a printer, a copier, a facsimile, and a multifunction printer (MFP), which perform the development by direct transfer using the toners. Furthermore, the invention is also applicable to a printer, a copier, a facsimile, and an MFP, which use inks instead of the toners.

The embodiments have described the genuine toner cartridge as the toner cartridge of the first type, and the non-genuine toner cartridge as the toner cartridge of the second type. Instead, the toner cartridge of the first type may be a toner cartridge loading an ordinary toner, for example, while the toner cartridge of the second type may be any of a toner cartridge loading a high gloss toner (a toner with a narrow fixation margin and a relatively low softening temperature) and a toner cartridge loading a low printing rate toner (a toner to which a relatively large amount of the external additive is externally added), for example.

In the above-described embodiments, image formation apparatus 1 notifies of the error by controlling the content to be displayed on the display of operation input device 33 based on either one of the first notification signal and the second notification signal. However, the error notification is not limited to the foregoing aspect. For example, image formation apparatus 1 may notify of an error by outputting a sound based on any one of the first notification signal and the second notification signal. Furthermore, image formation apparatus 1 may output any one of the first notification signal and the second notification signal to an external apparatus (for example, external apparatus 31), and the external apparatus may perform the error display based on the inputted notification signal.

Although, in the embodiments, controller 301 was explained as hardware, the functionality of controller 301 may be realized as software or as a combination of software and hardware.

The invention claimed is:

1. An image formation apparatus comprising:

an image formation device which forms an image on a medium;

an information reader which reads identification information stored in an information storage unit of a replaceable part in a state where the replaceable part is attached to the image formation apparatus;

an error detector which detects a value of a density of the image formed on the medium and detects an occurrence of an anomaly of the detected density value;

an error code storage unit having a first error code and a second error code stored therein, the first error code and the second error code each indicating a content of error display concerning the anomaly, the content of error display of the second error code being different from the content of error display of the first error code; and a controller which detects a replacement of the replaceable part based on the identification information stored in the information storage unit of the replaceable part, determines whether the replaceable part attached to the image formation apparatus is of a first type or a second type based on the identification information stored in the information storage unit, determines if the error detector detects the anomaly of the detected density value, and in response to the detection of the anomaly of the detected density value, outputs a first notification signal corresponding to the first error code if the replaceable part is of the first type and a second notification signal corresponding to the second error code if the replaceable part is of the second type.

2. The image formation apparatus according to claim 1, further comprising:

a display which displays the content based on at least one of the first notification signal and the second notification signal outputted from the controller.

3. The image formation apparatus according to claim 1, further comprising:

a determination information storage unit, wherein when the replaceable part is attached, the controller causes the determination information storage unit to store information based on the identification information stored in the information storage unit of the replaceable part, the information indicating whether the replaceable part is of the first type or the second type.

4. The image formation apparatus according to claim 1, further comprising:

a communication device which transmits at least one of the first notification signal and the second notification signal outputted from the controller, to a different apparatus on a network.

5. The image formation apparatus according to claim 1, wherein the image formation device includes an image carrier which carries an electrostatic latent image, and a development device which supplies a developer to a surface of the image carrier, and the replaceable part is a developer cartridge which stores the developer supplied to the development device.

6. The image formation apparatus according to claim 1, wherein the image formation device includes an image carrier which carries an electrostatic latent image, and a development device which supplies a developer to a surface of the image carrier, and the replaceable part is a printing device which includes the image carrier and the development device.

7. An error notification method performed by an image formation apparatus provided with an image formation device which forms an image on a medium, an information reader which reads identification information stored in an information storage unit of a replaceable part in a state where the replaceable part is attached to the image formation apparatus, an error detector which detects a value of a density of the image formed on the medium and detects an occurrence of an anomaly of the detected density value, and an error code storage unit having a first error code and a second error code stored therein, the first error code and the second error code each indicating a content of error display concerning the anomaly, the content of error display indicated by the second error code being different from the content of error display indicated by the first error code, the method comprising:

detecting a replacement of the replaceable part based on the identification information stored in the information storage unit of the replaceable part, determining whether the replaceable part attached to the image formation apparatus is of a first type or a second type based on the identification information stored in the information storage unit;

determining if the error detector detects the anomaly of the detected density value; and in response to the detection of the anomaly of the detected density value, outputting a first notification signal corresponding to the first error code if the replaceable part is of the first type and a second notification signal corresponding to the second error code if the replaceable part is of the second type.

8. The error notification method according to claim 7, further comprising:

displaying on a display the content based on at least one of the first notification signal and the second notification signal thus outputted.

9. The error notification method according to claim 7, further comprising:

storing in a determination information storage unit information based on the identification information stored in the information storage unit of the replaceable part when the replaceable part is attached, the information indicating whether the replaceable part is of the first type or the second type.

10. The error notification method according to claim 7, further comprising:

transmitting at least one of the first notification signal and the second notification signal thus outputted, to a different apparatus on a network.

11. An image formation apparatus comprising:

an image formation device which forms an image on a medium;

an information reader which reads identification information stored in an information storage unit of a replaceable part in a state where the replaceable part is attached to the image formation apparatus;

an error detector which detects a value of a density of the image formed on the medium and detects an occurrence of an anomaly of the detected density value;

an error code storage unit having a first error code and a second error code stored therein, the first error code and the second error code each indicating a content of error display concerning the anomaly, the content of error display of the second error code being different from the content of error display of the first error code;

a controller which detects a replacement of the replaceable part based on the identification information stored in the information storage unit of the replaceable part, determines whether the replaceable part attached to the image formation apparatus is of a first type or a second type based on the identification information stored in the information storage unit, determines if the error detector detects the anomaly of the detected density value, and when the error detector detects the anomaly of the detected density value, outputs a first notification signal corresponding to the first error code if the replaceable part is of the first type and a second notification signal corresponding to the second error code if the replaceable part is of the second type; and a history storage unit which stores history information indicating whether a previously-attached replaceable part, which was attached to the image formation apparatus immediately before a replaceable part currently attached to the image formation apparatus, is the first type or the second type, wherein the controller outputs the first notification signal corresponding to the first error code if the currently-attached replaceable part is of the first type and the stored history information indicates the previously-attached replaceable part is the first type when the error detector detects the anomaly of the detected density value, and outputs the second notification signal corresponding to the second error code if one of the currently-attached replaceable part and the previously-attached replaceable part is the second type when the error detector detects the anomaly of the detected density value.

12. An image formation apparatus comprising:

an image formation device which forms an image on a medium;

an information reader which reads identification information stored in an information storage unit of a replaceable part in a state where the replaceable part is attached to the image formation apparatus;

an error detector which detects a value of a density of the image formed on the medium and detects an occurrence of an anomaly of the detected density value;

an error code storage unit having a first error code and a second error code stored therein, the first error code and the second error code each indicating a content of error display concerning the anomaly, the content of error display of the second error code being different from the content of error display of the first error code;

a controller which detects a replacement of the replaceable part based on the identification information stored in the information storage unit of the replaceable part, determines whether the replaceable part attached to the image formation apparatus is of a first type or a second type based on the identification information stored in the information storage unit, determines if the error detector detects the anomaly of the detected density value, and when the error detector detects the anomaly of the detected density value, outputs a first notification signal corresponding to the first error code if the replaceable part is of the first type and a second notification signal corresponding to the second error code if the replaceable part is of the second type; and a history storage unit which stores history information indicating whether a replaceable part of the second type has been attached to the image formation apparatus in the past, wherein the error code storage unit has a third error code stored therein, the third error code being different from the first and second error codes, the controller outputs the first notification signal corresponding to the first error code if a currently-attached replaceable part, which is currently attached to the image formation apparatus, is of the first type and the stored history information indicates no replaceable part of the second type has been attached to the image formation apparatus when the error detector detects the anomaly of the detected density value, outputs the second notification signal corresponding to the second error code if the currently-attached replaceable part is of the second type when the error detector detects the anomaly of the detected density value, and outputs a third notification signal corresponding to the third error code if the currently-attached replaceable part is of the first type and the stored history information indicates at least one replaceable part of the second type has been attached to the image formation apparatus when the error detector detects the anomaly.

13. The error notification method according to claim 7, further comprising:

storing history information indicating whether a previously-attached replaceable part, which was attached to the image formation apparatus immediately before a replaceable part currently attached to the image formation apparatus, is the first type or the second type, wherein outputting the first notification signal comprises outputting the first notification signal corresponding to the first error code if the currently-attached replaceable part is of the first type and the stored history information indicates the previously-attached replaceable part is the first type, and outputting the second notification signal comprises outputting the second notification signal corresponding to the second error code if one of the currently-attached replaceable part and the previously-attached replaceable part is the second type.

14. The error notification method according to claim 7, further comprising:

storing history information indicating whether a replaceable part of the second type has been attached to the image formation apparatus in the past, wherein the error code storage unit has a third error code stored therein, the third error code being different from the first and second error codes, outputting the first notification signal comprises outputting the first notification signal corresponding to the first error code if a currently-attached replaceable part, which is currently attached to the image formation apparatus, is of the first type and the stored history information indicates no replaceable part of the second type has been attached to the image formation apparatus, outputting the second notification signal comprises outputting the second notification signal corresponding to the second error code if the currently-attached replaceable part is of the second type, and the method further comprises when the error detector detects the anomaly of the detected density value, outputting a third notification signal corresponding to the third error code if the currently-attached replaceable part is of the first type and the stored history information indicates at least one replaceable part of the second type has been attached to the image formation apparatus.

* * * * *